US010627089B2

(12) United States Patent
Qin

(10) Patent No.: US 10,627,089 B2
(45) Date of Patent: Apr. 21, 2020

(54) ELECTRONIC GLOW STICK

(71) Applicant: ACE LIGHT&ELECTRONIC TECH(NINGBO) CO., LTD., Ningbo (CN)

(72) Inventor: Yanbei Qin, Ningbo (CN)

(73) Assignee: ACE LIGHT&ELECTRONIC TECH(NINGBO) CO., LTD., Ningbo (CN)

( * ) Notice: Subject to any disclaimer, the term of this patent is extended or adjusted under 35 U.S.C. 154(b) by 222 days.

(21) Appl. No.: 15/827,567

(22) Filed: Nov. 30, 2017

(65) Prior Publication Data

US 2019/0120470 A1 Apr. 25, 2019

(30) Foreign Application Priority Data

Oct. 19, 2017 (CN) ..... 2017 1 0996626

(51) Int. Cl.

| | |
|---|---|
| ***F21V 23/02*** | (2006.01) |
| ***F21V 21/40*** | (2006.01) |
| ***F21V 7/00*** | (2006.01) |
| ***F21V 3/02*** | (2006.01) |
| ***F21L 4/00*** | (2006.01) |
| *F21Y 115/10* | (2016.01) |

(52) U.S. Cl.

CPC ..... *F21V 23/023* (2013.01); *F21L 4/005* (2013.01); *F21V 3/02* (2013.01); *F21V 7/00* (2013.01); *F21V 21/40* (2013.01); *F21Y 2115/10* (2016.08)

(58) Field of Classification Search

USPC ..... 362/157

See application file for complete search history.

(56) References Cited

U.S. PATENT DOCUMENTS

2010/0085738 A1* 4/2010 Bertken ..... F21L 4/02 362/157
2011/0141735 A1* 6/2011 Jablonski ..... B60Q 7/00 362/235
2012/0257377 A1* 10/2012 Schrimmer ..... F21L 4/027 362/119
2016/0345565 A1* 12/2016 Gilmartin ..... A01K 93/02

FOREIGN PATENT DOCUMENTS

CN 204141263 U 2/2015

* cited by examiner

*Primary Examiner* — Michael G Lee
*Assistant Examiner* — David Tardif
(74) *Attorney, Agent, or Firm* — AEON Law, PLLC; Adam L. K. Philipp; David V. H. Cohen

(57) ABSTRACT

Disclosed is an electronic glow stick comprising a stick body which is a tubular body, at least one handle in a plugged connection with an end of the stick body, a battery pack which is disposed in the handle and connected with the handle in a detachable way, and a light emitting element which is connected with the battery pack and electrically connected with batteries in the battery pack. The batteries can charge the light emitting element, and the light emitting element can project light in the stick body such that the stick body glows. The electronic glow stick has advantages of simple structure, low cost and high durability because of no circuit board; additionally, damaged parts can be exchanged instead of replacing the whole unit, thus effectively saving use cost; moreover, the handle is detachably connected with the stick body, so the whole glow stick has diversified structures.

15 Claims, 5 Drawing Sheets

ELECTRONIC GLOW STICK

BACKGROUND OF THE INVENTION

1. Technical Field

The present disclosure belongs to the photoelectric technical field, and relates to a glow stick, in particular to an electronic glow stick.

2. Description of Related Art

Glow sticks are stick-shaped, and used in entertaining, night fishing, weddings, outdoor use, military purposes, engineering construction, etc. The interlayer in a traditional glow stick is clamped by inner oxides and outer ester compounds. When impacted and twisted, the interlayer is broken, resulting in reactions between the oxides and the ester compounds, causing the fluorescent dye to glow. In use, the glow stick tends to leak liquid when shaken or bent, endangering the personal safety of users. For this reason, LED light bulbs are installed in the glow stick to glow and replace the reactants, preventing the glow stick from leaking liquid.

In response to this situation, glow sticks with real lights were invented. For example, the utility model, patent No. CN 204141263 U, discloses an LED glow stick, comprising an outer housing, LED light bulbs, batteries and a switch, and also comprising a flexible circuit. The outer housing is a flexible housing; the LED light bulbs are installed on the flexible circuit boards; circuit terminals on the flexible circuit boards, the batteries and the switch are connected in series; and the flexible circuit board, the switch and the batteries are all installed on the outer housing. This glow stick replaces the traditional glow stick, is safe in use, and prevents environmental pollution. However, this glow stick also has the following technical problems: 1. This glow stick glows through the use of LED light bulbs that are installed on the circuit board, but the circuit board has a relatively high cost, and is easily damaged in use, resulting in a short service life; 2. The LED light bulbs, batteries, switch and flexible circuit board are installed in the flexible outer housing, and the whole structure is integrated, so use is relatively inflexible and the use effect is relatively simple.

In conclusion, in order to solve the technical problems of the LED glow stick, an electronic glow stick with a simple structure, a long service life and diversified use effects is needed.

BRIEF SUMMARY OF THE INVENTION

The objective of the present disclosure is to provide an electronic glow stick which has a simple structure, a long service life and diversified use effects to overcome the above problems in the prior art.

The objective of the present disclosure can be achieved with the following technical solution. An electronic glow stick, including:

a stick body, which is a tubular structure;

at least one handle, the handle in a plugged connection with an end of the stick body;

a battery pack, disposed in the handle and connected with the handle in a detachable way;

a light emitting element, connected with the battery pack and electrically connected to batteries in the battery pack;

wherein the batteries charge the light emitting element, and the light emitting element is capable of projecting light into the stick body such that the stick body glows.

In the electronic glow stick, the rod is in a plugged connection with one of the ends of the stick body, while the other end of the stick body is covered with an end cap, and the light emitting element is capable of respectively projecting the light into the stick body and the end cap.

In the electronic glow stick, a light reflection layer is disposed on an inner surface in the end cap, opposite to the light emitting element.

In the electronic glow stick, two handles are provided and are respectively in a plugged connection with the two ends of the stick body.

In the electronic glow stick, a light absorbing layer is disposed on the inner surface of the stick body, and the light absorbing layer is capable of absorbing the light emitted by the light emitting element such that the stick body glows.

In the electronic glow stick, a light conducting layer which drives the stick body to glow uniformly is disposed on the inner surface of the stick body.

In the electronic glow stick, each one of the handles comprises two handle housings which are buckled with each other, wherein a positioning hole is formed on the inner surface of one of the handle housings, a positioning column is disposed in a protruding way on the inner surface of the other handle housing, and the positioning column is inserted in the positioning hole.

In the electronic glow stick, a limiting strip is disposed on each one of the two sides of the inner surface of each one of the handle housings, and the battery pack is clamped between the limiting strips of each one of the two handle housings.

In the electronic glow stick, the battery pack is provided with a limiting plate in a protruding way; the limiting plate is formed with a run-through limiting hole; a limiting column is disposed in a protruding way on the inner surface of the one of the handle housings, and the limiting column passes through the limiting hole and is in a detachable connection with the other handle housing.

In the electronic glow stick, one of the handle housings is also provided with and is in a threaded connection with a battery cover.

In the electronic glow stick, each one of the handles is also internally provided with a push board which extends out of each corresponding one of the handle housings; a contact sheet is disposed between each one the push boards and the battery pack; each one of the contact sheets has one end which extends into the battery pack and is electrically connected with the batteries, and the other end which contacts each corresponding one of the push boards; when each one of the push boards moves, each corresponding one of the contact sheets is capable of contacting the light emitting element, and the batteries and the light emitting element are electrified.

In the electronic glow stick, each one of the push boards is positioned between two upper limiting strips of one of the handle housings, and each one of the push boards is capable of axially moving with respect to the corresponding one of the handle housings between the two limiting strips.

In the electronic glow stick, one end, close to the light emitting element, of each one of the contact sheets is bent to form a contact end; each one of the contact sheets is internally transversely formed with an accommodating groove close to the bent end; a protruding strip is disposed on the lower surface of each one of the push boards; each one of the protruding strips is capable of being moved in or out of each corresponding one of the accommodating grooves, and the contact end is capable of contacting or leaving the light emitting element.

In the electronic glow stick, the battery pack is provided with a positioning block in a protruding way; two symmetric clamping blocks are transversely disposed on the surface of the positioning block; the light emitting element has two guide pins; the two guide pins both extend into the battery pack and are capable of being electrified by the batteries; the positioning block is located between the two guide pins and one of the guide pins is clamped between two clamping blocks.

In the electronic glow stick, clamping blocks are symmetrically disposed on the inner surfaces of the two handle housings in a protruding way; each one of the clamping blocks is formed with a clamping groove; and the light emitting element is positioned in the clamping grooves and is pressed against the clamping blocks.

In the electronic glow stick, one end of each one of the handles away from the stick body forms is formed with a hanging hole which runs through each one of the handles.

Compared with the prior art, the present disclosure has the following beneficial effects:

1. In the present invention, the light emitting element together with the battery pack and the batteries are installed in the handle, and the light emitting element is directly electrically connected with the batteries in the battery pack, thus omitting a circuit board, simplifying the structure, reducing cost, strengthening the glow stick to prevent damage, and prolonging the service life.

2. The handle is in a direct plugged connection with the stick body, so the handles and the stick body can be dismantled and assembled separately, and parts such as the light emitting element that are installed in the handles can be replaced, or when the handles or the stick body are damaged, the damaged parts can replaced separately without having to exchange the whole unit, effectively saving cost in use.

3. The handles are in a detachable connection with the stick body, so the structure of the whole glow stick is diversified; one of the handles can be plugged into one end of the stick body, and then decorations of various shapes or patterns can be plugged into the other end of the stick body, or the two handles can be respectively plugged into the two ends of the stick body, so the whole structure is flexible in use and achieves many effects in use.

Figure 1:
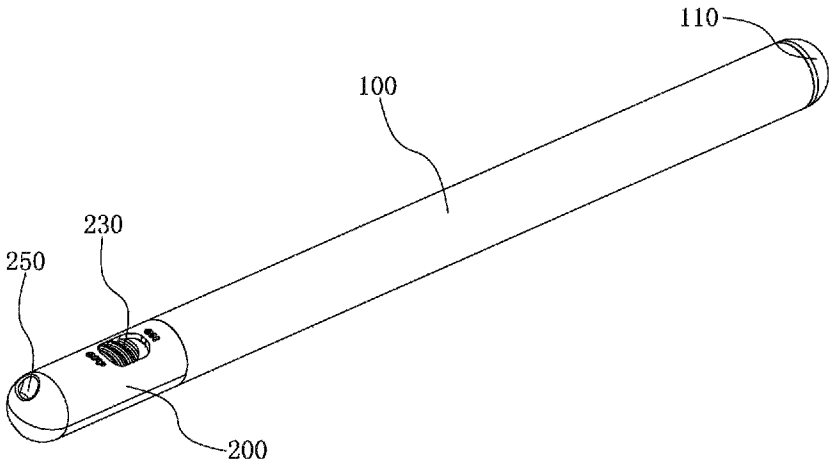
FIG. 1 is a front space diagram of the present disclosure.

In the drawings, 100. Stick body; 110. End cap;

200. Handle; 210. Upper handle housing; 221. Positioning hole; 212. Positioning sleeve; 213. Upper limiting strip; 214. Limiting column; 215. Upper clamping block; 216. Upper clamping groove; 220. Lower handle housing; 221. Positioning column; 222. Lower limiting strips; 223. Battery cover; 224. Lower clamping block; 225. Lower clamping groove; 230. Push board; 231. Protruding strip; 240. Contact sheet; 241. Contact terminal; 242. Accommodating groove; 250. Hanging hole;

300. Battery pack; 310. Limiting plate; 311. Limiting hole; 320. Positioning block; 321. Clamping block;

400. LED light; 410. Guide pin.

DETAILED DESCRIPTION OF THE INVENTION

The present disclosure is described below in further detail in conjunction with the specific embodiments and attached drawings. However, the present disclosure is not limited to those embodiments.

The present disclosure is an improvement on existing electronic glow sticks, aimed at simplifying the structure of existing electronic glow sticks, reducing cost, prolonging service life, making the structure more flexible in use and achieving better effects.

From FIG. 1-FIG. 5, the present disclosure provides an electronic glow stick, comprising a stick body 100, a handle 200, a battery pack 300 and a light emitting element.

The stick body 100 is a slim tubular structure, made of a flexible plastic material. The stick body 100 allows light to transmit. At least one handle 200 is provided, and the handle 200 is in a plugged connection with an end of the stick body 100. The battery pack 300 is axially disposed in the handle 200 and is connected with the handle 200 in a detachable way. The light emitting element is connected with the battery pack 300. Preferably, the light emitting element is an LED lamp 400. The LED lamp has two guide pins 410. The two guide pins 410 respectively serve as a cathode and an anode, extend into the battery pack 300 and can be electrically connected with the batteries. In use, the batteries can power the LED lamp 400, and the light emitted by the LED lamp 400 can be projected into the stick body 100 such that the stick body 100 glows, thus achieving the same effect as common glow sticks.

Compared with the existing electronic glow stick, the glow stick of the present disclosure does not include a circuit board, thus simplifying the structure, strengthening the glow stick to prevent damage in use, prolonging service life and reducing cost; the handle 200 is in a plugged connection with the stick body 100, such that the whole structure can be flexibly dismantled and installed, facilitating the replacement of parts, realizing recyclable use of some parts, saving cost, facilitating matching of the stick body 100 and the LED lamp 400 in different colors, and ensuring flexible use.

On the basis of the above structure, the present disclosure makes further improvements and details.

Figure 2:
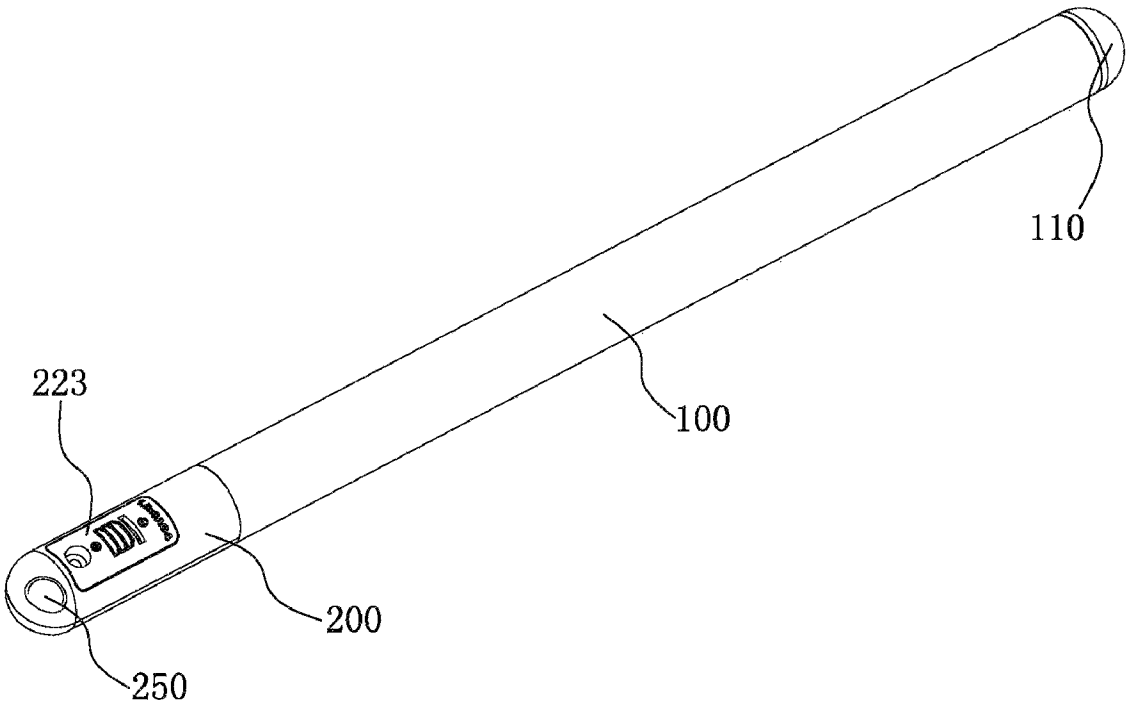
FIG. 2 is a rear space diagram of the present disclosure.
Figure 3:
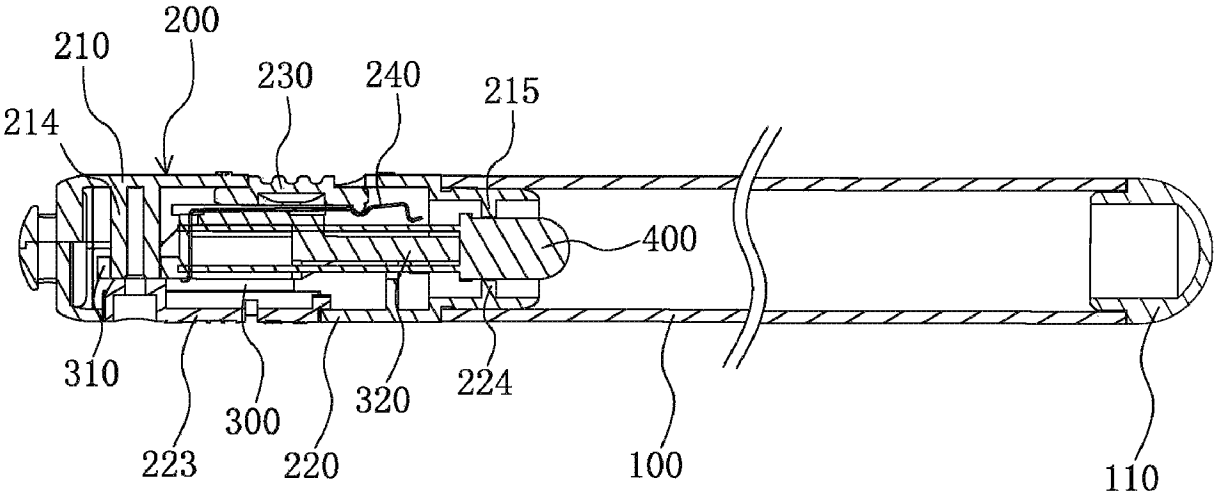
FIG. 3 is an axial sectional view of the present disclosure.

As shown in FIG. 1-FIG. 3, the handle 200 is in a plugged connection with one end of the stick body 100; an end cap 110 is disposed at the other end of the stick body 100; the light emitting element can respectively project the light into the stick body 100 and the end cap 110, which means that the handle 200 projects light from one end of the stick body 100 to the whole stick body 100, and the other end is capped by the end cap 110.

As one of the structures of the electronic glow stick, the light of the LED lamp 400 can be projected not only to the stick body 100, but also to the end cap 110, so the end cap 110 can also glow. Usually, in such circumstance, the end cap 110 can be in a different color from the stick body 100. In this way, the stick body 100 and the end cap 110 glow in different colors, creating a light effect which is different from that of traditional glow sticks. Additionally, the end cap 110 can also be made into various structures and in shapes, for example various cartoon figures, to achieve a better entertaining effect.

Further, a light reflecting layer (not shown in the figure) is disposed on the inner surface of the end cap 110, opposite to the light emitting element.

The stick body 100 has a certain length. When one end of the stick body 100 is fixed through the end cap 110, the closer a part is to the end cap 110 and the farther the part is away from the LED lamp 400, the dimmer the light is. Therefore, the brightness of the whole stick 100 is not uniform, affecting the light emitting effect of the whole product. On the contrary, with the light reflecting layer, the light of the LED lamp 400 radiates on the light reflecting layer and then is reflected to the stick body 100, greatly increasing the brightness of the stick body 100 at the end close to the end cap 110, so the whole stick body 100 glows more uniformly.

As an improvement, two handles 200 are provided and are respectively in a plugged connection with the two ends of the stick body 100. To facilitate understanding, this structure is not shown in the attached drawings.

As one of the various structures of the electronic stick body, this structure is different from the above structure. In this structure, the two handles 200, each with an LED lamp 400, are respectively plugged into the two ends of the stick body 100, and the LED lamps 400 in the two handles 200 can be different in color, so the whole stick body 100 presents different light effects at the two ends, or glows in different modes, thus increasing the glowing modes of the whole stick body and creating different light effects.

As an improvement, a light absorbing layer (not shown in the figures) is disposed on the inner surface of the stick body 100. The light absorbing layer can be a paper layer, or a coating layer which is applied to the inner surface of the stick body 100. The light absorbing layer can absorb the light of the light emitting element to drive the stick body 100 to glow.

This structure can be used in combination with any one of the above two structures. The light absorbing layer has the role of absorbing light energy. After the LED lamps 400 emit light for a period of time, the light absorbing layer absorbs and stores the light energy. At this time, the LED lamps 400 can be turned off, and the stick body 100 can still glow, thus saving battery power and reducing the energy consumption of the glow stick.

When the glow stick has only one LED lamp 400, the light at one end of the stick body 100 away from the LED lamp 400 is relatively dim, and the glow of the whole stick body 100 is not uniform. With the light absorbing layer, the glow of the whole stick body 100 is relatively uniform, and the glow stick achieves a better glowing effect.

As an improvement, a light conducting layer (not shown in the figures) which drives the stick body 100 to glow uniformly is disposed on the inner surface of the stick body 100.

Like the light absorbing layer, the light conducting layer also plays a role of improving the uniformity of the glow of the whole stick body 100, and can be used as an alternate solution to the light absorbing layer. Some effects of the light conducting layer and the light absorbing layer are the same, but the two layers use different methods to make the glow of the stick body 100 uniform. The differences can be reflected on selected materials or structures. In addition, the light conducting layer must be used in combination with the LED lamp 400 to glow, but after absorbing light, the light absorbing layer can glow independently without needing the support from the LED lamp 400.

Figure 4:
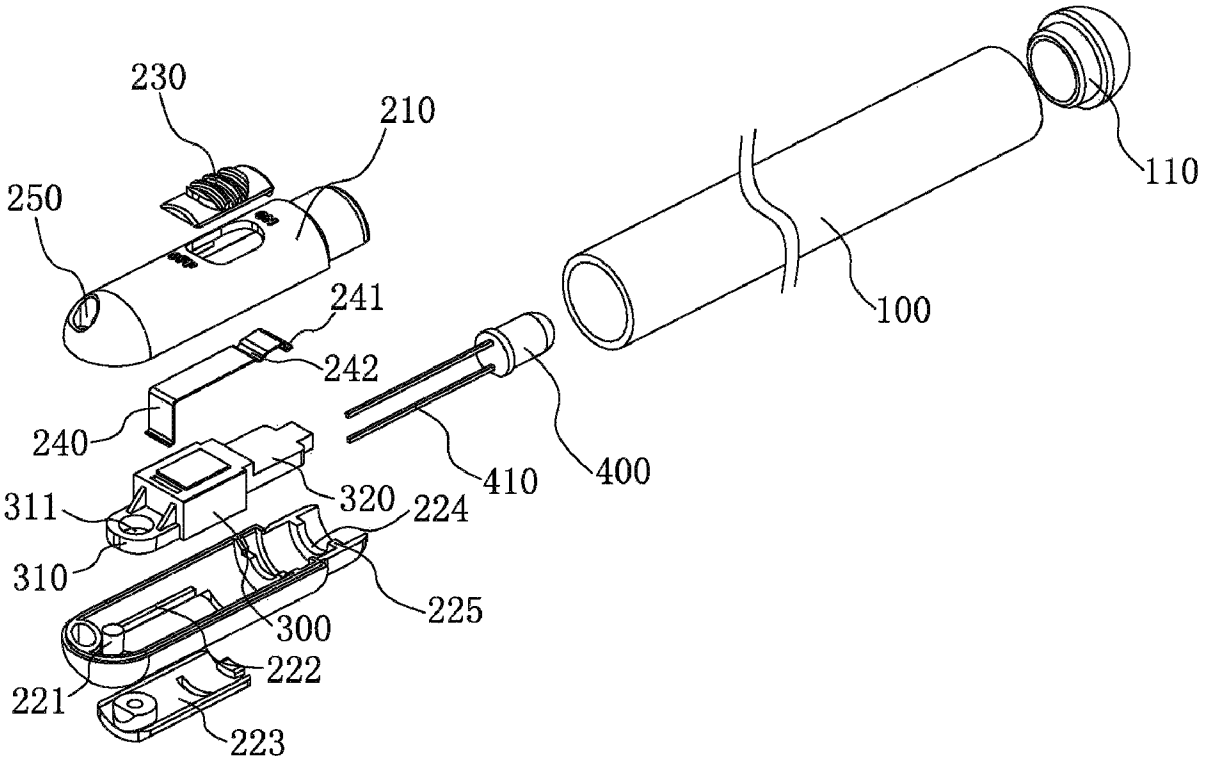
FIG. 4 is a front exploded view of the present disclosure.
Figure 5:
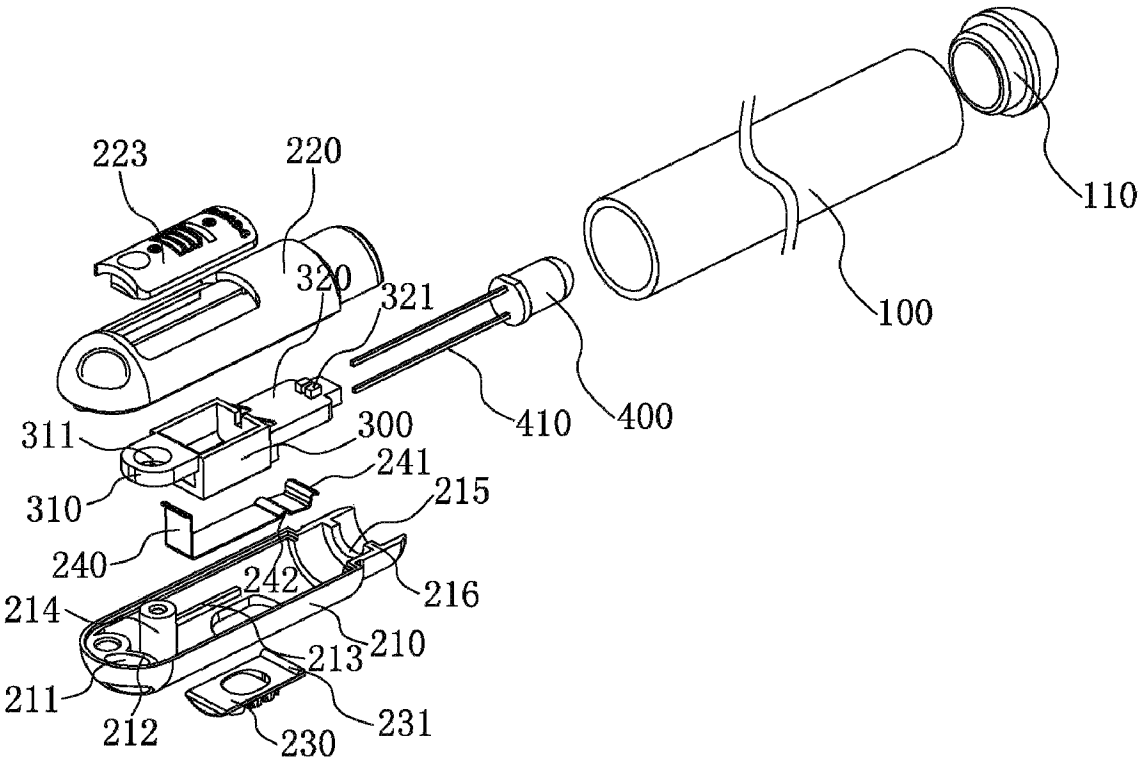
FIG. 5 is a rear exploded view of the present disclosure.

As shown in FIG. 4 and FIG. 5, each one of the handles 200 includes two handle housings which are buckled to each other, and the battery pack 300 and the LED lamps 400 are both positioned between the two handle housings. To facilitate understanding, the two handle housings are respectively defined as an upper handle housing 210 and a lower handle housing 220.

Further, a positioning hole 211 is formed on the inner surface of each one of the upper handle housings 210. Preferably, a positioning sleeve 212 is disposed at one end of the inner surface, away from the stick body 100, of each one of the upper handle housings 210; each one of the positioning holes 211 is formed above each one of the positioning sleeves 212; a positioning column 221 is correspondingly disposed in a protruding way on the inner surface of each corresponding one of the lower handle housings 220, and each one of the positioning columns 221 is plugged in each corresponding one of the positioning holes 211.

Each one of the handles 200 is formed by assembling each corresponding of the upper handle housings 210 and each corresponding one of the lower handle housings 220. To facilitate installation of the parts such as the battery pack 300 and the LED lamps 400, the upper handle housings 210 and the lower handle housings 220 can be quickly positioned and buckled during assembling through the match between the positioning holes 211 and the positioning columns 221, enhancing the efficiency of assembling between the upper handle housings 210 and the lower handle housings 220.

As shown in FIG. 4 and FIG. 5, upper limiting strips 213 are respectively axially disposed on two sides of the inner surface of each one of the upper handle housings 210; lower limiting strips 222 are correspondingly disposed on two sides of each one of the lower handle housings 220; the upper part of the battery pack 300 is clamped between the two upper limiting strips 213, and the lower part of the battery pack 300 is clamped between the corresponding upper limiting strips 213 and lower limiting strips 222.

Each one of the upper handle housings 210 is internally provided with the upper limiting strips 213, and each one of the lower handle housings 220 is internally provided with lower limiting strips 222, so the upper and lower parts of the battery pack 300 are transversely limited, avoiding the transverse movement of the battery pack 300 in the handles 200, and enhancing the transverse stability of the battery pack 300. This is critical for the normal contact between the batteries and the LED lamps 400 and can ensure that the LED lamps 400 emit light normally.

Further, as shown in FIG. 2-4, a battery cover 223 which is in a threaded connection with one of the lower handle housings 220 is disposed on the corresponding one of the lower handle housings 220. The battery cover 223 faces the opening of the battery pack 300, and the battery pack 300 is detachable, facilitating replacement of batteries.

As shown in FIG. 4 and FIG. 5, a limiting plate 310 is axially disposed in a protruding way at one end of the battery pack 300 away from the stick body 100; the limiting plate 310 is formed with a run-through limiting hole 311; a limiting column 214 is correspondingly disposed in a protruding way on the inner surface of the corresponding one of the upper handle housings 210, wherein each one of the limiting columns 214 passes through each corresponding one of the limiting holes 311 and is connected to the corresponding one of the lower handle housings 220 in a detachable way with screws.

The match between the limiting columns 214 and the limiting plates 310 enhances the assembly speed of the battery pack 300. At the same time, through the effect of the limiting columns 214, the battery pack 300 cannot move axially, enhancing the stability of the battery pack 300 in the axial direction.

As shown in FIG. 3-5, each one of the handles 200 is internally provided with a push board 230 which extends out of the upper handle housings 210. Preferably, each one of the push boards 230 is disposed between the corresponding two upper limiting strips 213; each one of the push boards 230 can move axially between the corresponding upper limiting strips 213 with respect to corresponding upper handle housings 210; a contact sheet 240 is disposed between each one of the push boards 230 and the battery pack 300; each one of the contact sheets 240 is integrally L-shaped, with one end which extends into the battery pack 300 and is electrically connected with the batteries, with the other end which contacts each corresponding one of the push boards 230. Two guide pins 410 of each one of the LED lamps 400 both extend into the battery pack 300, and one of the guide pins 410 contacts a corresponding one of the contact sheets 240; when each one of the push boards 230 is moved, each one of the contact sheets 240 can contact one of the guide pins 410 of each corresponding one of the LED lamps 400, and the batteries are electrified with the LED lamps 400.

That is to say, under normal conditions, only the cathodes or anodes of the LED lamps 400 contact the contact sheets 240. In such circumstance, the batteries cannot power the LED lamps 400. When moved, each one of the push boards 230 extrudes each corresponding one of the contact sheets 240 such that each corresponding one of the contact sheets 240 contacts one of the guide pins 410 of each corresponding one of the LED lamps 400, so that the cathode and anode of each one of the LED lamps 400 respectively communicate with the anode and cathode of batteries, and each one of the LED lamps 400 emits light. Through the configuration of the push boards 230 and the contact sheets 240, the LED lamps 400 are conveniently controlled to be switched on or off from the outside of the handles 200. Additionally, each one of the push boards 230 moves between the corresponding two upper limiting strips 213 such that the two upper limiting strips 213 play the role of transversely limiting the push board 230, so the push boards 230 have relatively high movement accuracy and good movement stability.

Further, one end, close to each corresponding one of the LED lamps 400, of each one of the contact sheets 240 bends toward the direction of the guide pins 410 of the corresponding one of the LED lamps 400 to form a contact terminal 241, facilitating the contact between the contact sheets 240 and the guide pins 410, and improving the on-off sensitivity of the LED lamps 400. In addition, each one of the contact sheets 240 is internally transversely formed with an accommodating groove 242 close to the bent end, and correspondingly, a protruding strip 231 is transversely disposed on the lower surface of each one of the push boards 230; when each one of the protruding strips 231 is positioned in each corresponding one of the accommodating grooves 242, each corresponding one of the contact sheets 240 leaves the corresponding one of the guide pins 410; and when each one of the protruding strips 231 extrudes each corresponding one of the accommodating grooves 242, each corresponding one of the contact sheets 240 contacts the corresponding one of the guide pins 410.

The accommodating grooves 242 play a limiting role. When each one of the protruding strips 231 is positioned in each corresponding one of the accommodating grooves 242, each corresponding one of the push boards 230 is limited from moving, thus preventing each corresponding one of the contact sheets 240 from easily contacting the corresponding one of the guide pins 410 and then switching on the corresponding one of the LED lamps 400; when each one of the push boards 230 is pushed with a slightly large thrust force, each corresponding one of the protruding strips 231 leaves from each corresponding one of the limiting grooves and extrudes and pushes each corresponding one of the contact sheets 240, such that each corresponding one of the contact sheets 240 contacts the corresponding one of the guide pins 410.

As shown in FIG. 4 and FIG. 5, the battery pack 300 is provided with a positioning block 320 in a protruding way at one end close to the stick body 100; two clamping blocks 321 are transversely symmetrically disposed on the lower surface of the positioning block 320; the positioning block 320 is positioned between two guide pins 410 and one of the guide pins is clamped with the two clamping blocks 321.

The positioning block 320 plays the role of further fixing the whole battery pack 300 and also ensures the stability of the LED lamps 400 at the same time. The two clamping blocks 321 clamp the guide pins 410 of each one of the LED lamps 400, avoiding the LED lamps 400 from shaking left and right and enhancing the stability of the LED lamps 400 in the transverse direction.

Further, an upper clamping block 215 is disposed on the inner surface of each one of the upper handle housings 210 in a protruding way, each one of the upper clamping blocks 215 is formed with an upper clamping groove 216; correspondingly, a lower clamping block 224 is disposed on the inner surface of each one of the lower handle housings 220 in a protruding way, each one of the lower clamping blocks 224 is formed with a lower clamping groove 225; the light emitting elements are positioned between the upper clamping grooves 216 and the lower clamping blocks 225 and are pressed against the upper clamping blocks 215 and the lower clamping blocks 224.

The clamping blocks hold the LED lamps 400 such that each one of the LED lamps 400 remains fixed with respect to each corresponding one of the handles 200, enhancing the stability of the light emitting portions of the LED lamps 400.

Further, each one of the handles 200 is formed with a hanging hole 250, which runs through each corresponding one of the upper handle housing and each corresponding one of the lower handle housings, at one end away from the stick body 100. A threading rope can go through the hanging hole 250 such that the glow stick can be suspended on the neck. Therefore, the glow stick is conveniently carried.

The specific embodiments described in the text are used for illustrating the principle of the present disclosure only. Those skilled in the field can make various amendments or supplementations or take similar substitutions on the basis of the described specific embodiments. These amendments, supplementations and substitutions shall fall within the principle or the protective scope claimed by the claims of the present disclosure.

What is claimed is:

1. An electronic glow stick, comprising:

a stick body, which is a tubular structure;

at least one handle, the handle in a plugged connection with an end of the stick body;

a battery pack, disposed in the handle and connected with the handle in a detachable way;

a light emitting element, connected with the battery pack and electrically connected to batteries in the battery pack;

wherein the batteries charge the light emitting element, and the light emitting element is capable of projecting light into the stick body such that the stick body glows; and the at least one handle comprises two handle housings which are buckled with each other, wherein a positioning hole is formed on the inner surface of one of the handle housings, a positioning column is disposed in a protruding way on the inner surface of the other handle housing, and the positioning column is inserted in the positioning hole.

2. The electronic glow stick according to claim 1, characterized in that the at least one handle is in a plugged connection with one of the ends of the stick body, while the other end of the stick body is covered with an end cap, and the light emitting element is capable of projecting the light to the stick body and the end cap.

3. The electronic glow stick according to claim 2, characterized in that a light reflection layer is disposed on an inner surface in the end cap, opposite to the light emitting element.

4. The electronic glow stick according to claim 1, characterized in that two handles are provided and are respectively in a plugged connection with the two ends of the stick body.

5. The electronic glow stick according to claim 1, characterized in that a light absorbing layer is disposed on the inner surface of the stick body, and the light absorbing layer is capable of absorbing the light emitted by the light emitting element such that the stick body glows.

6. The electronic glow stick according to claim 1, characterized in that a light conducting layer which drives the stick body to glow uniformly is disposed on the inner surface of the stick body.

7. The electronic glow stick according to claim 1, characterized in that a limiting strip is disposed on each one of the two sides of the inner surface of each one of the handle housings, and the battery pack is clamped between the limiting strips of each one of the two handle housings.

8. The electronic glow stick according to claim 1, characterized in that, the battery pack is provided with a limiting plate in a protruding way; the limiting plate is formed with a run-through limiting hole; a limiting column is disposed in a protruding way on the inner surface of the one of the handle housings, and the limiting column passes through the limiting hole and is in a detachable connection with the other handle housing.

9. The electronic glow stick according to claim 1, characterized in that one of the handle housings is also provided with and is in a threaded connection with a battery cover.

10. The electronic glow stick according to claim 1, characterized in that each one of the handles is also internally provided with a push board which extends out of each corresponding one of the handle housings; a contact sheet is disposed between each one the push boards and the battery pack; each one of the contact sheets has one end which extends into the battery pack and is electrically connected with the batteries, and the other end which contacts each corresponding one of the push boards; when each one of the push boards moves, each corresponding one of the contact sheets is capable of contacting the light emitting element, and the batteries and the light emitting element are electrified.

11. The electronic glow stick according to claim 10, characterized in that each one of the push boards is positioned between two upper limiting strips of one of the handle housings, and each one of the push boards is capable of axially moving with respect to the corresponding one of the handle housings between the two limiting strips.

12. The electronic glow stick according to claim 9, characterized in that one end, close to the light emitting element, of each one of the contact sheets is bent to form a contact end; each one of the contact sheets is internally transversely formed with an accommodating groove close to the bent end; a protruding strip is disposed on the lower surface of each one of the push boards; each one of the protruding strips is capable of being moved in or out of each corresponding one of the accommodating grooves, and the contact end is capable of contacting or leaving from the light emitting element.

13. The electronic glow stick according to claim 1, characterized in that the battery pack is provided with a positioning block in a protruding way; two symmetric clamping blocks are transversely disposed on the surface of the positioning block; the light emitting element has two guide pins; the two guide pins both extend into the battery pack and are capable of being electrified by the batteries; the positioning block is located between the two guide pins and one of the guide pins is clamped between two clamping blocks.

14. The electronic glow stick according to claim 1, characterized in that clamping blocks are symmetrically disposed on the inner surfaces of the two handle housings in a protruding way; each one of the clamping blocks is formed with a clamping groove; and the light emitting element is positioned in the clamping grooves and is pressed against the clamping blocks.

15. The electronic glow stick according to claim 1, characterized in that one end of the at least one handle away from the stick body forms a hanging hole which runs through the at least one handle.

* * * * *